US010760777B2

(12) United States Patent
Krieger

(10) Patent No.: US 10,760,777 B2
(45) Date of Patent: Sep. 1, 2020

(54) LED PUCK HOLDER FOR WIRE ROPE TENSION GRIDS

(71) Applicant: InterAmerica Stage, Inc., Sanford, FL (US)

(72) Inventor: Thomas Krieger, Suessen (DE)

(73) Assignee: InterAmerica Stage, Inc., Sanford, FL (US)

( * ) Notice: Subject to any disclaimer, the term of this patent is extended or adjusted under 35 U.S.C. 154(b) by 0 days.

(21) Appl. No.: 15/915,854

(22) Filed: Mar. 8, 2018

(65) Prior Publication Data

US 2018/0259167 A1 Sep. 13, 2018

Related U.S. Application Data

(60) Provisional application No. 62/468,935, filed on Mar. 8, 2017.

(51) Int. Cl.

| | |
|---|---|
| ***F21V 19/00*** | (2006.01) |
| ***F21V 23/06*** | (2006.01) |
| ***F21V 21/008*** | (2006.01) |
| ***F21V 23/00*** | (2015.01) |
| ***F21K 9/20*** | (2016.01) |
| ***F21Y 115/10*** | (2016.01) |
| ***F21W 131/406*** | (2006.01) |

(52) U.S. Cl.

CPC ..... *F21V 19/0035* (2013.01); *F21K 9/20* (2016.08); *F21V 21/008* (2013.01); *F21V 23/001* (2013.01); *F21V 23/06* (2013.01); *F21W 2131/406* (2013.01); *F21Y 2115/10* (2016.08)

(58) Field of Classification Search

CPC .. F21V 19/0035; F21V 21/008; F21V 23/001; F21V 23/06; F21K 9/20; F21Y 2115/10; F21W 2131/406

USPC ..... 362/249.06

See application file for complete search history.

(56) References Cited

U.S. PATENT DOCUMENTS

| | | | | |
|---|---|---|---|---|
| 8,104,928 | B1 * | 1/2012 | Horn | F21V 21/30 362/287 |
| 8,231,261 | B2 * | 7/2012 | Gherardini | F21K 9/00 362/640 |
| 8,602,608 | B2 * | 12/2013 | Derks | F21V 15/01 362/249.02 |
| 2005/0221659 | A1 * | 10/2005 | Mrakovich | F21V 21/002 439/404 |
| 2009/0279298 | A1 * | 11/2009 | Mier-Langner | F21V 21/096 362/235 |
| 2010/0172143 | A1 * | 7/2010 | Cunius | F21S 8/04 362/373 |
| 2016/0109108 | A1 * | 4/2016 | Sommerschuh | F21V 29/503 362/549 |

* cited by examiner

*Primary Examiner* — Cara E Rakowski
*Assistant Examiner* — Jessica M Apenteng
(74) *Attorney, Agent, or Firm* — Michael L. Leetzow, P.A.

(57) ABSTRACT

A light puck that attaches to a wire rope tension grid has a top cover with a plurality of slots to receive wire ropes therein and a corresponding bottom cover. There is also a light fixture having a plurality of LEDs disposed between the top cover and the bottom cover, the light fixture aligned with an opening in the bottom cover. A biasing plate is positioned between the light fixture and the top cover and has adjustment screw associated therewith to bias the biasing plate relative to the top cover.

19 Claims, 11 Drawing Sheets

LED PUCK HOLDER FOR WIRE ROPE TENSION GRIDS

REFERENCE TO RELATED CASE

This application claims priority under 35 U.S.C. § 119(e) to provisional application No. 62/468,935 filed on Mar. 8, 2017, the contents of which are hereby incorporated by reference in their entirety.

BACKGROUND OF THE INVENTION

In auditoriums and other venues for performances and shows, there needs to be a way for the venue personnel to move equipment, lighting, sound equipment, etc. around above any stage and possibly around above where the audience may sit for the performances. There is a wire rope tension grid system, the SkyDeck system, which has been installed in venues all over the world. The SkyDeck system allows for equipment to be moved without worrying about the specific location or limits to the location of the equipment. The equipment can be located just about anywhere with the open SkyDeck System. The system is described in U.S. Pat. No. 8,672,092 and at least one other pending application. The contents of the patent are incorporated herein by reference.

An improvement on that system would be to allow LEDs (light emitting diodes) to be attached to the wire rope tension grids for a number of reasons. First, the LEDs above the stage and/or crowd allow for additional lighting effects. Numerous images could be illuminated on the wire rope tension grid system using the LEDs to enhance the performance, provide additional light before and after the performance, etc. However, the LEDs need to be installed on the wire rope tension grids so that they do not interfere with the use of the wire rope tension grids or the personnel moving around on the wire rope tension grids.

Naturally, installation high above a stage can be a safety hazard for the person who is installing or replacing the LEDs. Additionally, the attachment means can not get in the way or cause a tripping hazard to the users. Thus, an LED puck has been designed that attaches to the wire rope tension grid in a safe and secure manner, while not providing a tripping hazard. Additionally, the LED puck can be loosened sufficiently to allow the wire ropes to be moved sufficiently to allow the user to make an opening in the wire rope tension grid that is large enough for equipment to be passed therethrough.

SUMMARY OF THE INVENTION

The present invention is directed to a light puck for attachment to a wire rope tension grid that includes a top cover, a bottom cover, a light fixture disposed between the top cover and the bottom cover, the light fixture aligned with an opening in the bottom cover, and a biasing plate disposed between the light fixture and the top cover.

In some embodiments, light fixture includes a plurality of light emitting diodes (LEDs).

In some other embodiments, biasing plate has an adjustment screw associated therewith to bias the biasing plate relative to the top cover and the light fixture.

In another embodiment, the top cover has a plurality of slots to receive wire ropes from the wire rope tension grid therein, the plurality of slots on an internal surface of the top portion and extending to at least one side surface of the top cover.

According to another aspect of the present invention, there is a light puck for attachment to a wire rope tension grid that includes a top cover having a plurality of slots to receive wire ropes therein, the plurality of slots on an internal surface of the top portion, a bottom cover, a light fixture having a plurality of LEDs, the light fixture disposed between the top cover and the bottom cover, the light fixture aligned with and extending through an opening in the bottom cover, a biasing plate disposed between the light fixture and the top cover, and an adjustment screw associated therewith to bias the biasing plate relative to the top cover.

In another embodiment, there is a top cover has a plurality of slots to receive wire ropes from the wire rope tension grid therein, the plurality of slots on an internal surface of the top portion and extending to at least one side surface of the top cover and wherein the biasing plate is disposed between the top cover and the wire ropes from the wire rope tension grid when installed on the wire rope tension grid.

It is to be understood that both the foregoing general description and the following detailed description of the present embodiments of the invention are intended to provide an overview or framework for understanding the nature and character of the invention as it is claimed. The accompanying drawings are included to provide a further understanding of the invention, and are incorporated into and constitute a part of this specification. The drawings illustrate various embodiments of the invention and, together with the description, serve to explain the principles and operations of the invention.

DETAILED DESCRIPTION OF THE INVENTION

Figure 1:
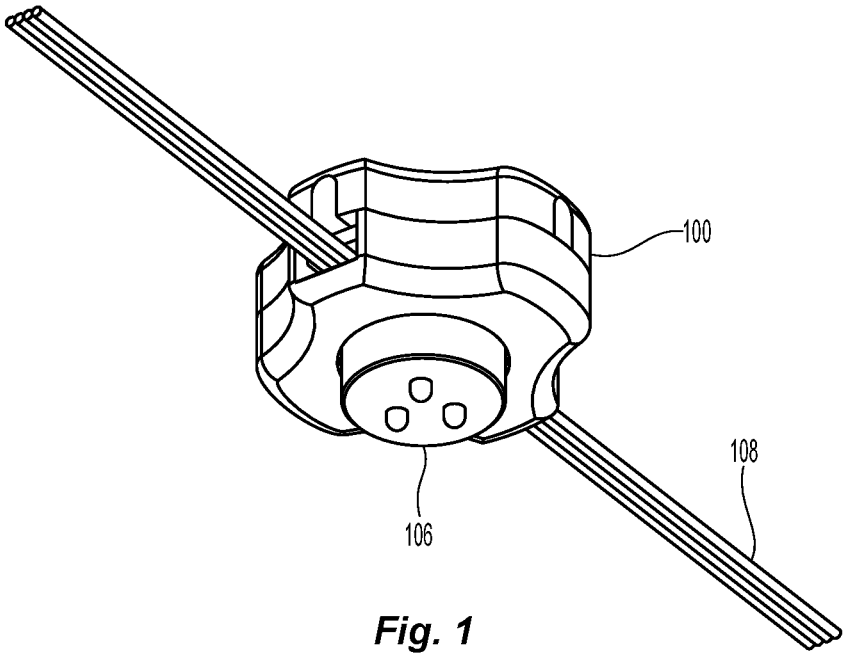
FIG. 1 is a perspective view from the underside of the LED puck with a portion of the LED lights installed therein.

Reference will now be made in detail to the present preferred embodiment(s) of the invention, examples of which are illustrated in the accompanying drawings. Whenever possible, the same reference numerals will be used throughout the drawings to refer to the same or like parts.

Figure 2:
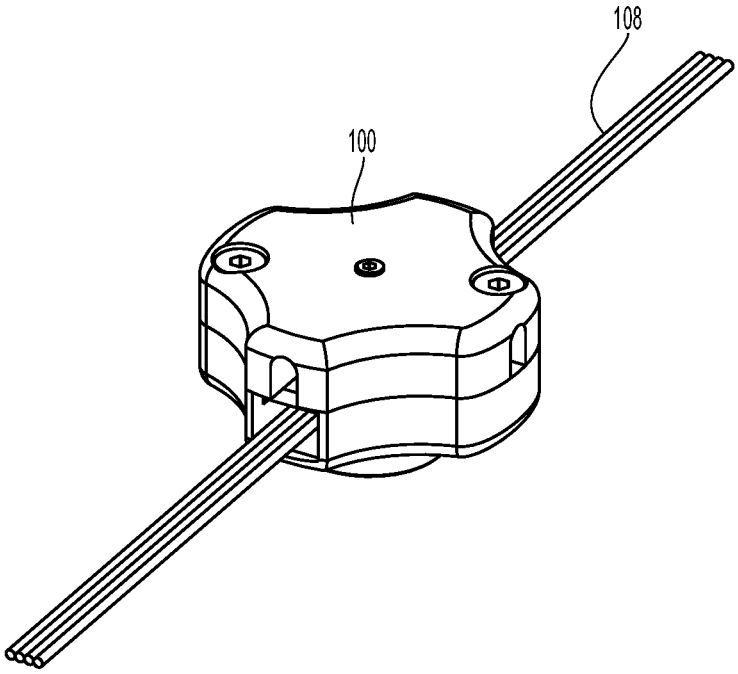
FIG. 2 is a perspective view from the top side of the LED puck of FIG. 1.
Figure 3:
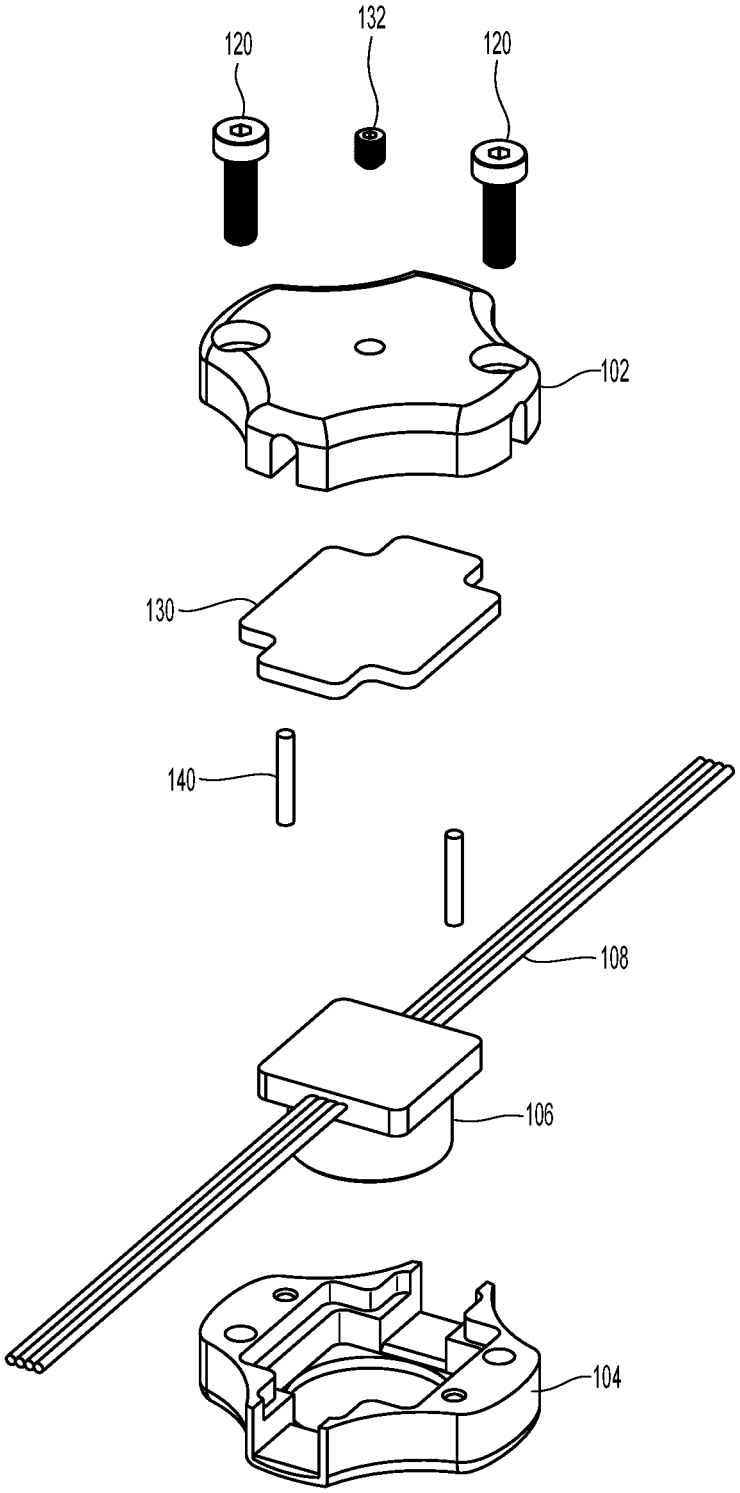
FIG. 3 is a perspective, exploded view of the LED puck of FIG. 1.
Figure 4:
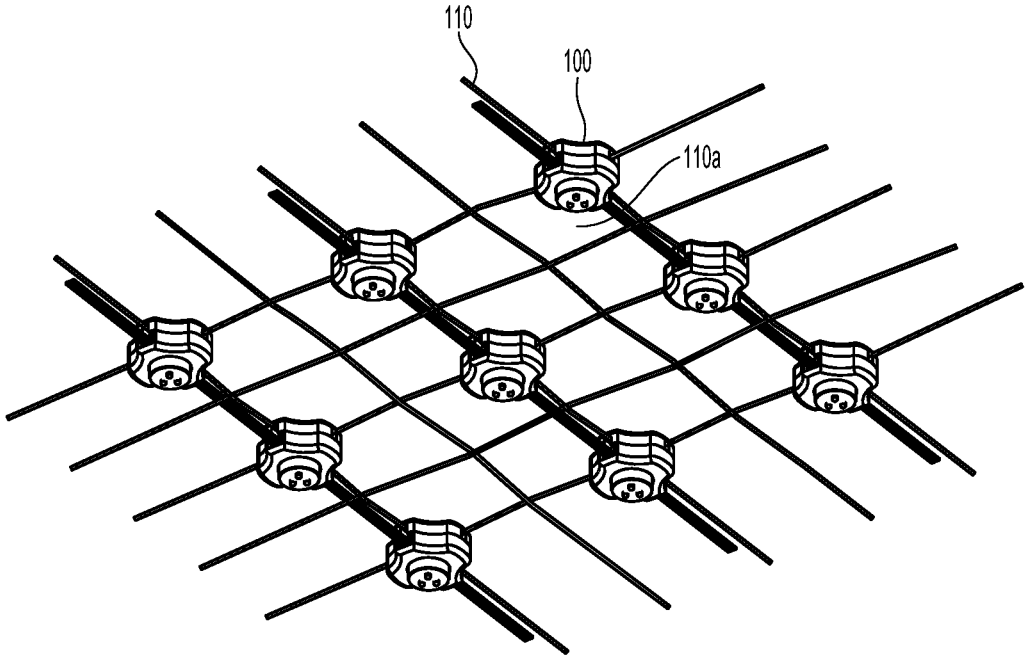
FIG. 4 is a perspective view from the underside of one embodiment of a portion of a single wire rope tension grid with a plurality of LED pucks installed thereon.
Figure 5:
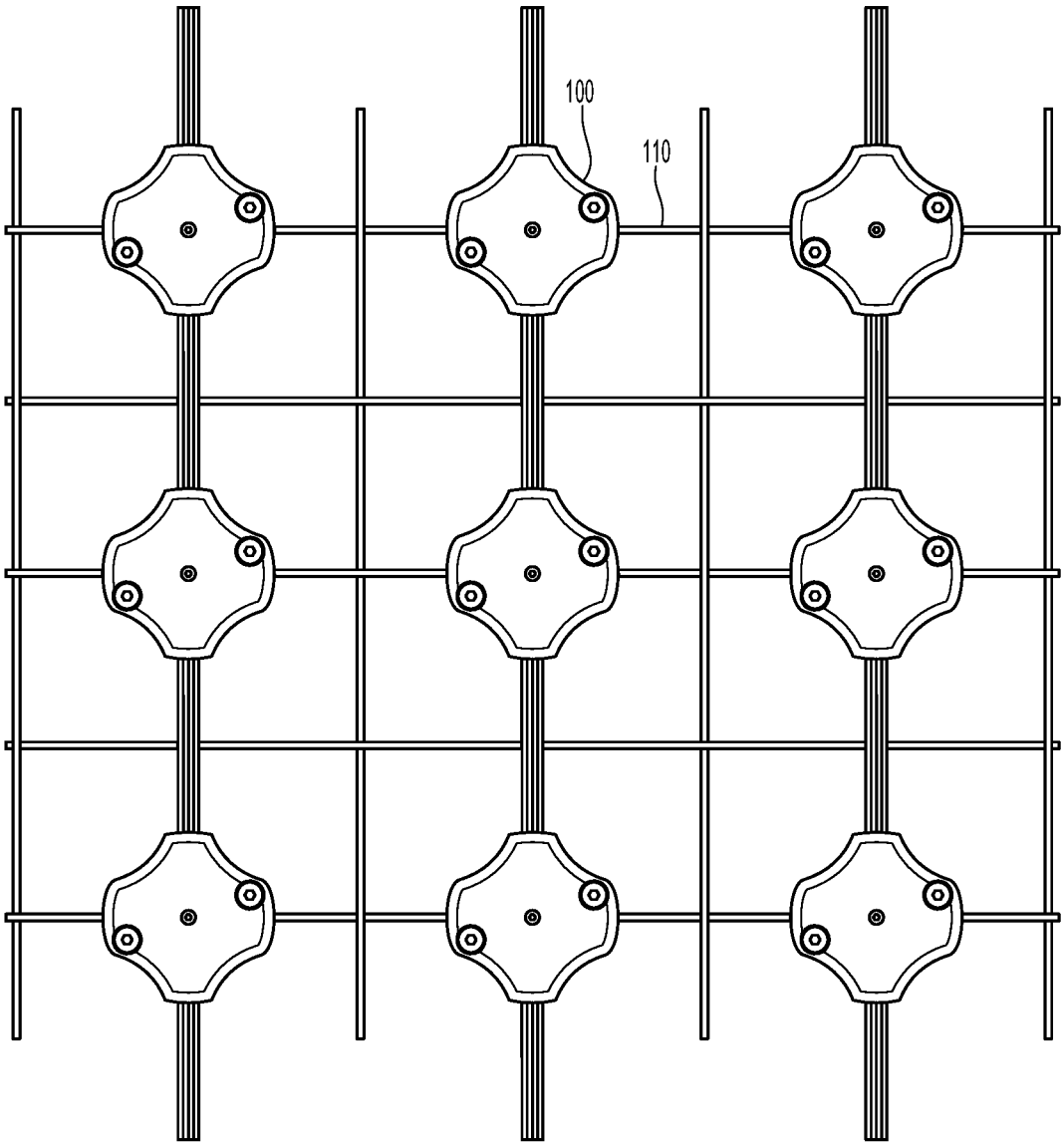
FIG. 5 is view from the bottom of the portion of the wire rope tension grid of FIG. 4.
Figure 6:
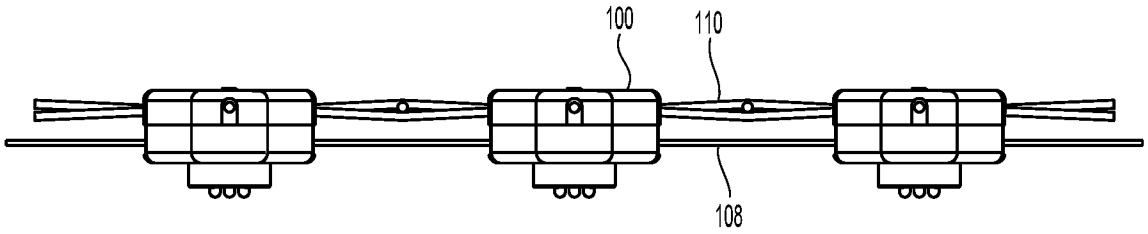
FIG. 6 is a side view of the portion of the wire rope tension grid of FIG. 4.
Figure 7:
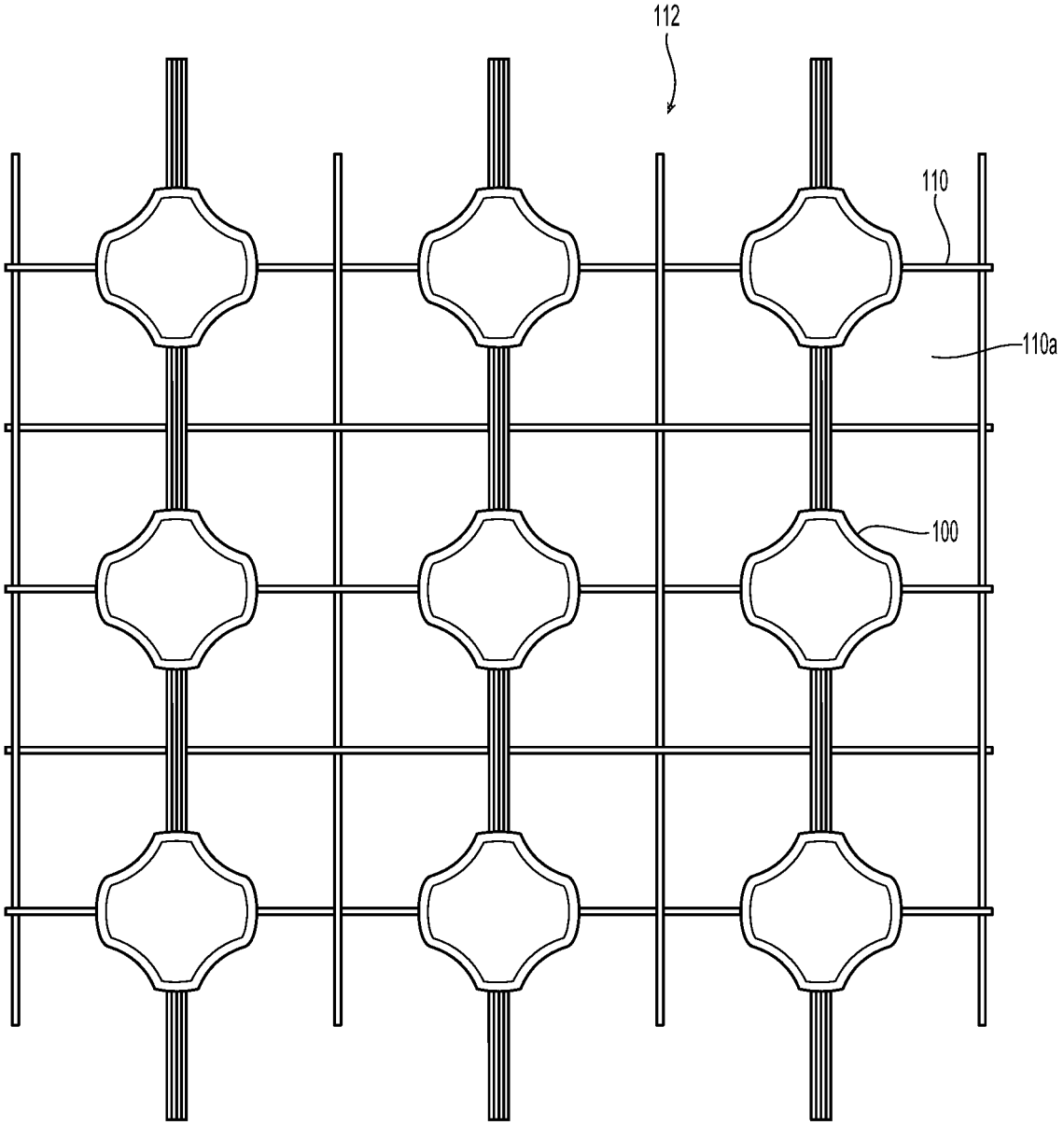
FIG. 7 is a top view of a portion of a wire rope tension grid with a plurality of LED pucks.
Figure 8:
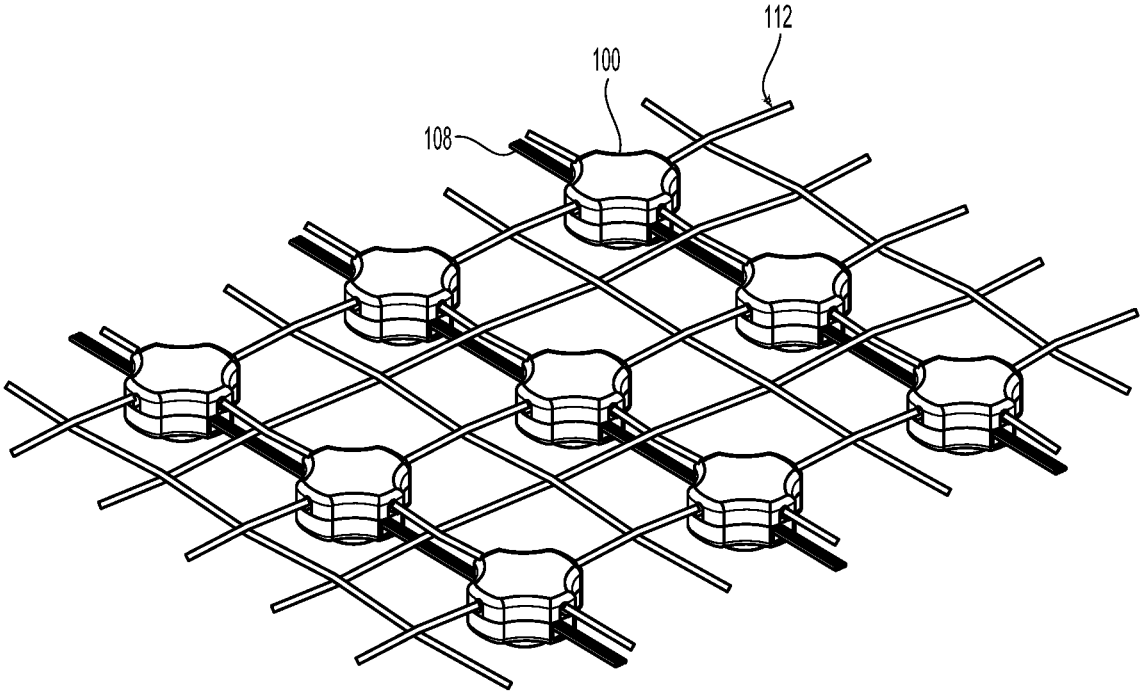
FIG. 8 is a top perspective view of the portion of the wire rope tension grid of FIG. 7.
Figure 9:
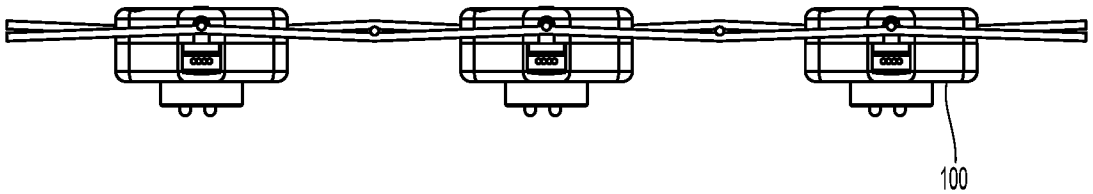
FIG. 9 is a first side view of the portion of the wire rope tension grid of FIG. 7.
Figure 10:
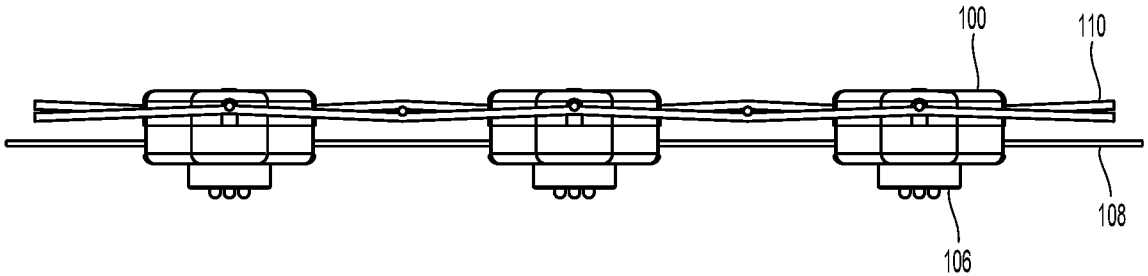
FIG. 10 is a second side view of the portion of the wire rope tension grid of FIG. 7.
Figure 12:
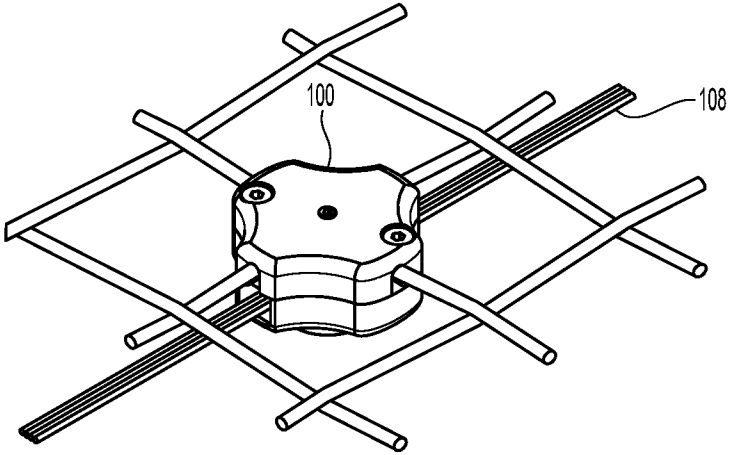
FIG. 12 is top perspective view of the LED puck attached to a portion of a wire rope tension grid of FIG. 11.
Figure 11:
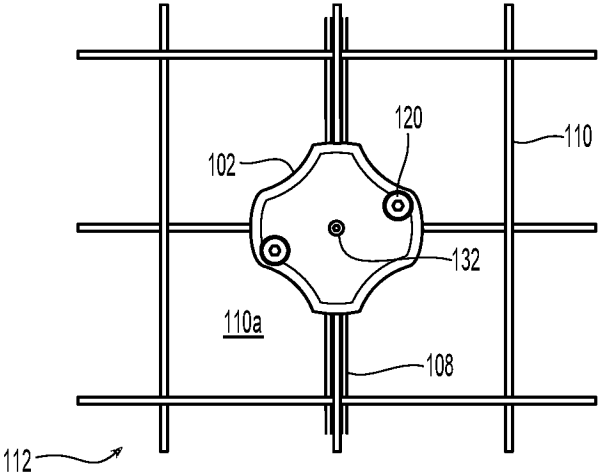
FIG. 11 is a top view of one LED puck attached to a portion of a wire rope tension grid.
Figure 14:
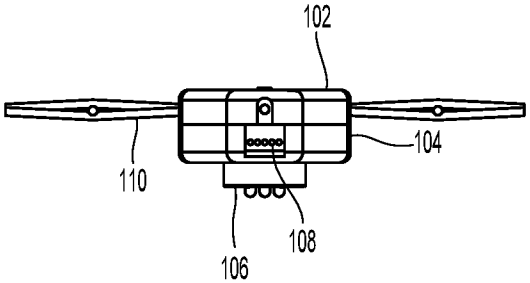
FIG. 14 is a second side view of the LED puck of FIG. 11.
Figure 13:
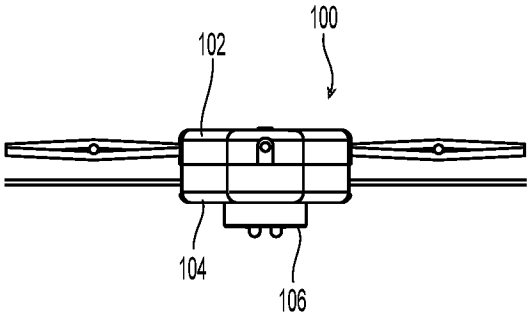
FIG. 13 is a first side view of the LED puck of FIG. 11.
Figure 15:
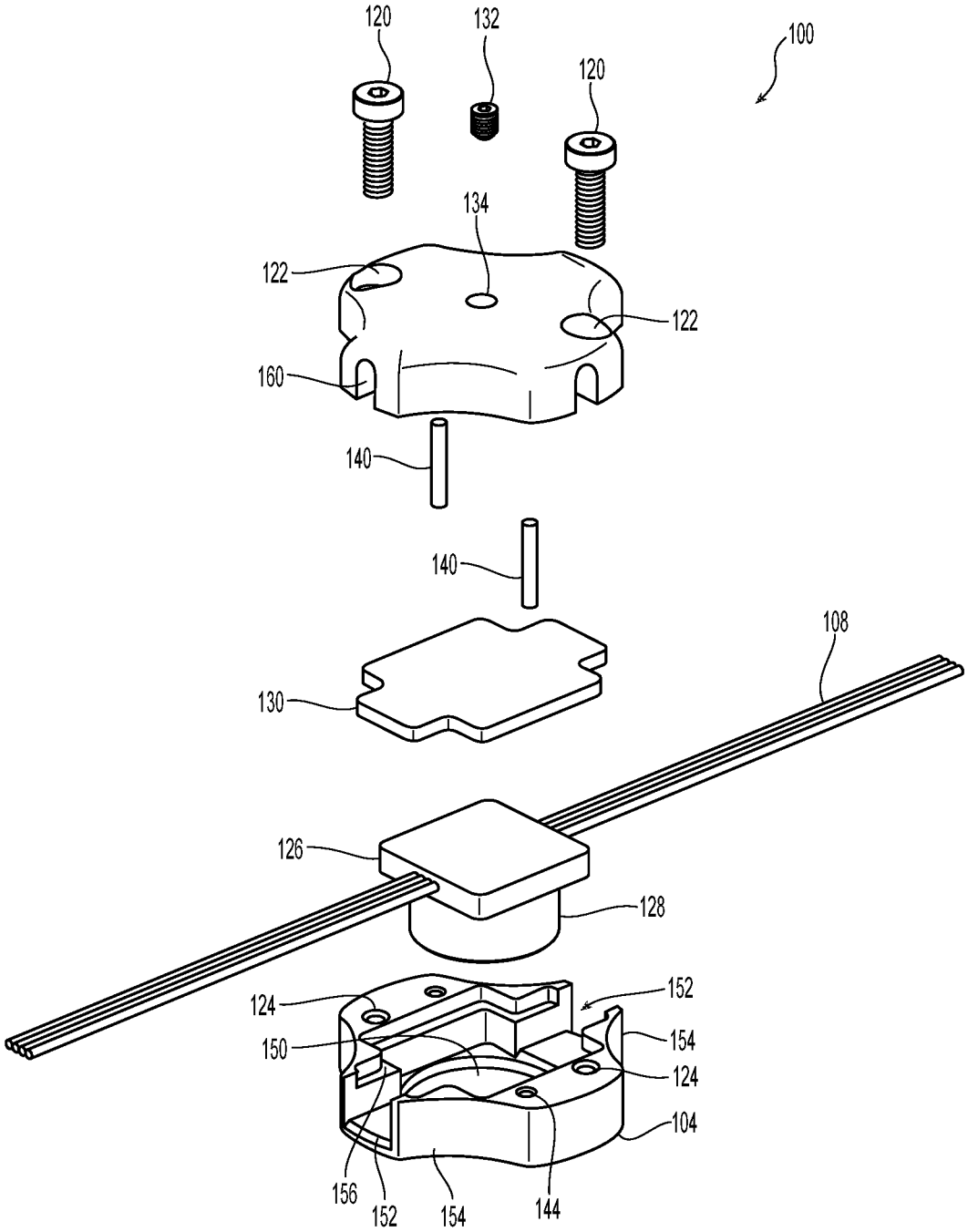
FIG. 15 is an exploded, perspective view of the LED puck from the top.
Figure 16:
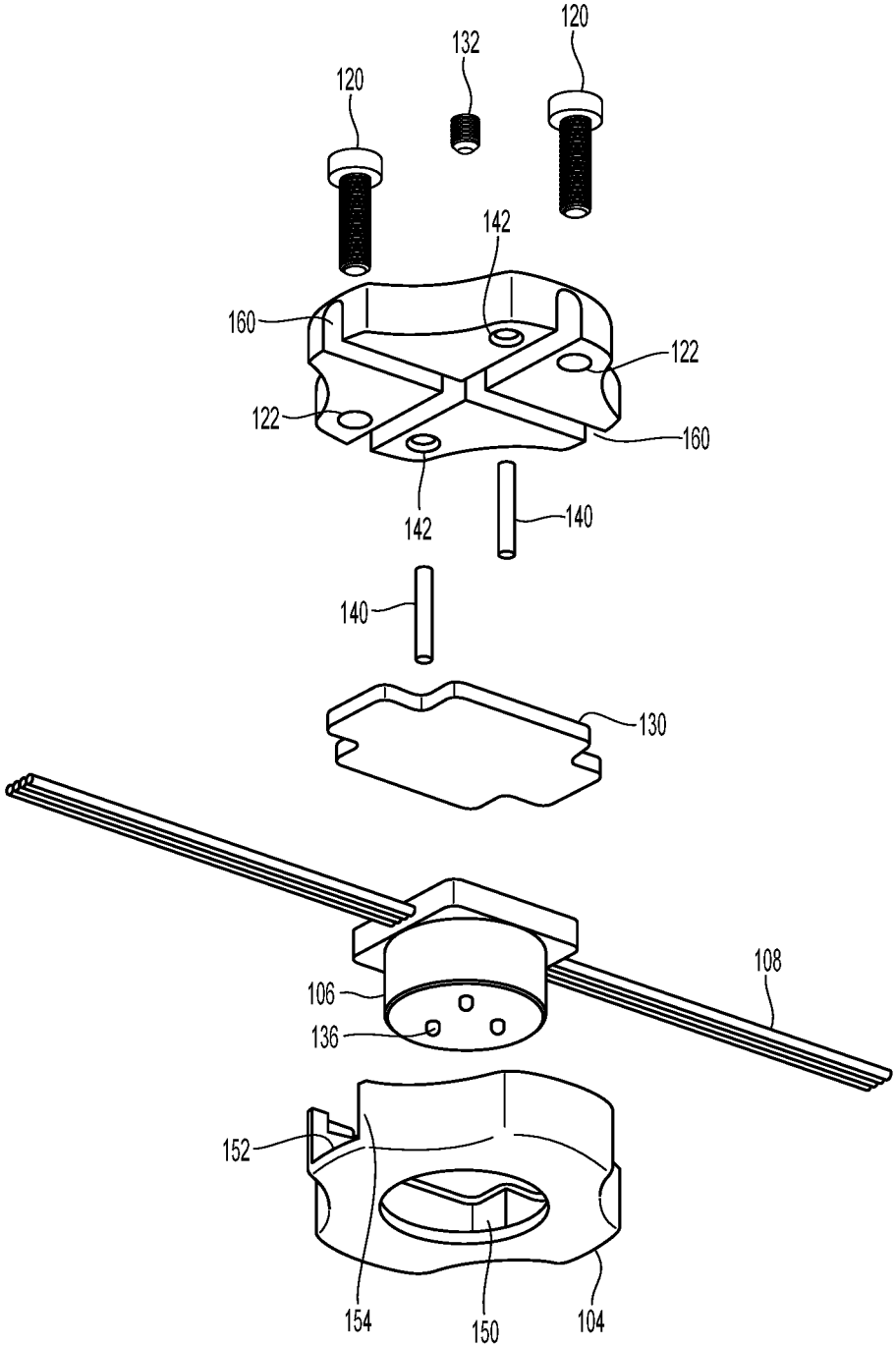
FIG. 16 is an exploded, perspective view of the LED puck from underneath.

FIGS. 1-16 show one embodiment of a LED puck 100 according to the present invention. The LED puck has a top cover 102 and a bottom cover 104 that mates with the top cover 102. The top and bottom covers 102, 104 sandwich a lighting fixture 106 with the electrical wires 108 and the wire ropes 110 of the wire rope tension grid 112. The top cover 102 is preferably secured to the bottom cover 104 with two screws 120. The screws 120 pass through openings 122 in the top cover 102 and engage threaded openings 124 in the bottom cover 104. Alternatively, the screws 120 could engage nuts (not shown) to secure the bottom cover 104. The screws 120 and openings 124 may also be reversed—the screws 120 pass through openings in the bottom cover 104 to engage the top cover 102. Other means of securing the covers could also be used as long as there is the ability to remove the covers (e.g., they get damaged and need to be replaced, access to the LED fixture is needed, etc.).

The lighting fixture 106 is preferably an LED lighting fixture. The lighting fixture 106 has a base 126 and a lighting portion 128. The lighting fixture 106 preferably has three different color LEDs 136 in the lighting portion 128. Typically the LEDs are red, green and blue, but could be of any appropriate colors for the installation of the puck 100. Additionally, more or fewer LEDs could be used with the lighting fixture 106 and still fall within the scope of the present invention.

The LED puck 100 also has a biasing plate 130 that is disposed between the covers 102,104. The biasing plate 130 is disposed between the top cover 102 and the wire ropes 110 of the wire rope tension grid 112. A set screw 132 is inserted through a threaded opening 134 in the top cover 102 to push the biasing plate 130 onto the wire ropes 110 and onto the back portion of the lighting fixture 106. This keeps the LED puck 100 pressed on the wire ropes 110 and from sliding around.

The LED puck also has two alignment pins 140 that mate with alignment openings or recesses 142 in the top cover 102 and alignment openings 144 in the bottom cover 104. The alignment pins 140 keep the biasing plate 130 positioned between the lighting fixture 106 (and more particularly the base 126 and the top cover 102.

The LED fixture 106 is disposed in the bottom cover 104 in an opening 150 that is configured to have the same shape as the lighting portion 128 of the LED fixture 104. The lighting portion 128 preferably extends through the opening 150 of the bottom cover 104. However, it may be aligned in other configurations with the opening 150 such as being recessed in the bottom cover 104 or even with the opening 150 in the bottom cover 104. The bottom cover 104 preferably has two openings 152 in opposite side walls 154 to allow the electrical wires 108 to exit the base 126 of the LED puck 100. As is known in the art, there are a plurality of LED fixtures 106 on one length of the electrical wires 108. Thus, the openings 152 in side walls 154 allow a number of lighting fixtures 106 to be connected to one another. There may also be other structures 156 in the bottom cover 104 that match up with the base 126 and the lighting portion 128 of the lighting fixture 106 to keep it aligned to the LED puck 100.

The top cover 102 also has four slots 160 to receive a portion of the wire ropes 110 at a crossing point of the wire ropes 110. It should be noted that the wire ropes 110 do have some movement so that a person could make an opening 110*a* larger to allow the person could reach through the wire rope tension grid from on top. To be able to move the wire ropes 110 where an LED puck is located, the set screw 132 is loosened, which in turn loosens the biasing plate 130. Then the LED puck 100 can be moved along one of the wire ropes 110 to allow the opening 110*a* to be made larger or smaller. Then the set screw 132 can be tightened in the new position or the LED puck 100 can be returned to the former position before being tightened again.

The top cover 102 preferable has rounded edges to prevent presenting a surface against which a person could trip while walking across the wire rope tension grid. Also, it is preferable that the top cover 102 be thinner than the bottom cover 102, again presenting as little area for tripping.

It will be apparent to those skilled in the art that various modifications and variations can be made to the present invention without departing from the spirit and scope of the invention. Thus it is intended that the present invention cover the modifications and variations of this invention provided they come within the scope of the appended claims and their equivalents.

I claim:

1. A light puck for attachment to a wire rope tension grid comprising:

a top cover;

a bottom cover;

a light fixture disposed between the top cover and the bottom cover, the light fixture aligned with an opening in the bottom cover to shine light through the opening; and a biasing plate disposed between the light fixture and the top cover; and wherein the top cover has a plurality of slots to receive wire ropes from the wire rope tension grid therein, the plurality of slots on an internal surface of the top portion and extend to at least one side surface of the top cover.

2. The light puck according to claim 1, wherein the light fixture includes a plurality light emitting diodes (LEDs).

3. The light puck according to claim 1, wherein the biasing plate has an adjustment screw associated therewith to bias the biasing plate relative to the top cover and the light fixture.

4. The light puck according to claim 1, further including alignment pins extending between the top and bottom cover and being adjacent the biasing plate.

5. The light puck according to claim 1, wherein the top and bottom covers are removably attached to one another.

6. The light puck according to claim 1, the light fixture is electrically connected to at least one other light fixture in another light puck.

7. The light puck according to claim 1, wherein the bottom cover has two slots in opposing side walls, each of the slots configured to receive electrical wires associated with the light fixture.

8. A light puck for attachment to a wire rope tension grid comprising:

a top cover;

a bottom cover;

a light fixture disposed between the top cover and the bottom cover, the light fixture aligned with an opening in the bottom cover to shine light through the opening; and a biasing plate disposed between the light fixture and the top cover, wherein the biasing plate is disposed between the top cover and the wire ropes from the wire rope tension grid when installed on the wire rope tension grid.

9. A light puck for attachment to a wire rope tension grid comprising:

a top cover having a plurality of slots to receive wire ropes therein, the plurality of slots on an internal surface of the top portion;

a bottom cover;

a light fixture having a plurality of LEDs, the light fixture disposed between the top cover and the bottom cover, the light fixture aligned with and extending through an opening in the bottom cover;

a biasing plate disposed between the light fixture and the top cover; and an adjustment screw associated therewith to bias the biasing plate relative to the top cover.

10. The light puck according to claim 9, further including alignment pins extending between the top and bottom cover.

11. The light puck according to claim 9, wherein the top and bottom covers are removably attached to one another.

12. The light puck according to claim 9, wherein the top cover has a plurality of slots to receive wire ropes therein, the plurality of slots on an internal surface of the top portion.

13. The light puck according to claim 9, the light fixture is electrically connected to at least one other light fixture in another light puck.

14. The light puck according to claim 9, wherein the bottom cover has two slots in opposing side walls, each of the slots configured to receive electrical wires associated with the light fixture.

15. The light puck according to claim 9, wherein the bottom cover has an interior and the interior is configured to receive the light fixture therein.

16. The light puck according to claim 9, wherein the top cover and bottom cover have rounded corners.

17. The light puck according to claim 9, wherein the top cover has a first thickness and the bottom cover has a second thickness, the first thickness being smaller than the second thickness.

18. The light puck according to claim 9, wherein the top cover has a plurality of slots to receive wire ropes from the wire rope tension grid therein, the plurality of slots on an internal surface of the top portion and extending to at least one side surface of the top cover and wherein the biasing plate is disposed between the top cover and the wire ropes from the wire rope tension grid when installed on the wire rope tension grid.

19. The light puck according to claim 9, further including alignment pins extending between the top and bottom cover and being adjacent the biasing plate.

* * * * *